US011536170B2

(12) United States Patent
Tamari et al.

(10) Patent No.: US 11,536,170 B2
(45) Date of Patent: Dec. 27, 2022

(54) CRANKSHAFT BEARING STRUCTURE

(71) Applicant: Mazda Motor Corporation, Hiroshima (JP)

(72) Inventors: Hirotaka Tamari, Aki-gun (JP); Shigeru Wada, Aki-gun (JP); Yukio Misaki, Aki-gun (JP); Koji Kumagai, Aki-gun (JP); Tatsunori Sasaki, Aki-gun (JP); Takahiro Onda, Aki-gun (JP)

(73) Assignee: Mazda Motor Corporation, Hiroshima (JP)

( * ) Notice: Subject to any disclaimer, the term of this patent is extended or adjusted under 35 U.S.C. 154(b) by 0 days.

(21) Appl. No.: 17/649,493

(22) Filed: Jan. 31, 2022

(65) Prior Publication Data

US 2022/0282647 A1 Sep. 8, 2022

(30) Foreign Application Priority Data

Mar. 8, 2021 (JP) ..... JP2021-036366

(51) Int. Cl.
*F01M 11/02* (2006.01)

(52) U.S. Cl.
CPC ..... *F01M 11/02* (2013.01); *F01M 2011/026* (2013.01)

(58) Field of Classification Search
CPC . F01M 11/02; F01M 1/02; F01M 1/06; F01M 1/16; F01M 2001/062; F01M 2011/026; F16N 2270/22; F16N 2270/60; F16N 27/005
See application file for complete search history.

(56) References Cited

U.S. PATENT DOCUMENTS 4,567,815 A * 2/1986 Kocher ..... F16C 7/023 92/DIG. 1
5,138,991 A * 8/1992 Wojdyla ..... F16C 3/14 123/196 R
5,152,373 A * 10/1992 Callies ..... F01M 1/06 123/196 R

FOREIGN PATENT DOCUMENTS

JP 2015034572 A 2/2015

* cited by examiner

*Primary Examiner* — Grant Moubry
*Assistant Examiner* — Ruben Picon-Feliciano
(74) *Attorney, Agent, or Firm* — Alleman Hall Creasman & Tuttle LLP

(57) ABSTRACT

A crankshaft bearing structure is provided, in which a crankshaft includes a first crank journal and a second crank journal, and a crank pin disposed therebetween. First upper-and-lower journal bearings and second upper-and-lower journal bearings are attached to the respective crank journals, and each upper bearing includes an oil hole connected to an oil passage to supply oil to between the crank journal and the journal bearings. An in-shaft oil passage is formed in the crankshaft to draw oil from an outer circumferential surface of the second crank journal to an outer circumferential surface of the crank pin. The second upper journal bearing has, on an inner circumferential surface thereof, a circumferential groove connected to the oil hole. The oil is supplied to between the first upper-and-lower journal bearings and the first crank journal, only through a passage passing through the oil hole of the first upper journal bearing.

8 Claims, 6 Drawing Sheets

CRANKSHAFT BEARING STRUCTURE

TECHNICAL FIELD

The present disclosure relates to a crankshaft bearing structure, and particularly, relates to a structure of an in-shaft oil passage formed inside a crankshaft, and a structure of a journal bearing attached around a crank journal.

BACKGROUND OF THE DISCLOSURE

An engine of a vehicle includes a crankshaft for outputting a rotary-driving force, a cylinder block having bearing parts which axially support the crankshaft, and a cylinder head attached above the cylinder block. Journal bearings are interposed between the bearing parts of the cylinder block and crank journals of the crankshaft, respectively. Each journal bearing is comprised of a combination of an upper journal bearing and a lower journal bearing each having a semi-annular shape in a front view in an axial direction of the crankshaft. In the conventional art, some of the upper journal bearings attached to the crank journals are formed with an oil hole. The oil hole of the upper journal bearing is connected to an oil gallery. Oil supplied from the oil gallery through the oil hole to between an inner circumferential surface of the journal bearing and an outer circumferential surface of the crank journal lubricates between the journal bearing and the crank journal.

Further, the crankshaft includes a crank pin formed between two crank journals. The crank pin is coupled to a connecting rod coupled to a piston, such that the connecting rod is rotatable. A connecting rod bearing is interposed between the connecting rod and the crank pin. The connecting rod bearing and the crank pin are lubricated therebetween by a part of oil which is supplied to between the journal bearing and the crank journal being supplied through an in-shaft oil passage formed inside the crankshaft. As one example of the conventional art, a crankshaft disclosed in JP2015-034572A is described with reference to FIG. 6.

As illustrated in FIG. 6, a crankshaft 90 is provided with crank journals 91-95 and crank pins 96-99 which are aligned alternately in a direction of an axis Ax90 of the crankshaft 90. The crank journals 91-95 are coaxial with the axis Ax90, whereas the crank pins 96-99 are disposed eccentrically with respect to the axis Ax90. In the crankshaft 90 of JP2015-034572A, openings 91*b*, 92*b*, 93*b*, 94*b*, and 95*b* are formed in outer circumferential surfaces 91*a*, 92*a*, 93*a*, 94*a*, and 95*a* of all of the crank journals 91-95, and openings 96*b*, 97*b*, 98*b*, and 99*b* are formed in outer circumferential surfaces 96*a*, 97*a*, 98*a*, and 99*a* of the crank pins 96-99, respectively.

Inside the crankshaft 90, in-shaft oil passages 900-907 connected between the openings 91*b*, 92*b*, 93*b*, 96*b*, and 97*b*, and in-shaft oil passages 908-914 connected between the openings 94*b*, 95*b*, 98*b*, 99*b* are formed. According to the crankshaft of JP2015-034572A, part of the oil supplied from an oil gallery is introduced into the in-shaft oil passages 900-914 from the openings 92*b* and 94*b* (see arrows D1 and D2). Then, the oil introduced into the in-shaft oil passages 903 and 908 from the openings 92*b* and 94*b*, respectively, is led to the other openings 91*b*, 93*b*, 95*b*, 96*b*, 97*b*, 98*b*, and 99*b* through the in-shaft oil passages 900-902, 904-907, 909-914 (see arrows D3-D16).

In the crankshaft 90 of JP2015-034572A, oil supplied to between the crank journals 92 and 94 and journal bearings attached around the crank journals 92 and 94 also lubricates between the other crank journals 91, 93, and 95 and journal bearings, and between the crank pins 96-99 and connecting rod bearings.

Note that in the technology disclosed in JP2015-034572A, circumferential grooves connected to oil holes and extending in a circumferential direction are provided to upper journal bearings which are attached to the crank journals 92 and 94, respectively. These circumferential grooves function as a passage to lead oil from the openings 92*b* and 94*b* provided to the crank journals 92 and 94, to the in-shaft oil passages 903 and 908 and lower journal bearings, respectively.

However, in the conventional crankshaft 90 having the in-shaft oil passages 900-914 illustrated in FIG. 6, it is a concern that the centrifugal force caused by rotation of the crankshaft 90 (see an arrow C) may lead to a decrease in hydraulic pressure. That is, in the oil passage passing through the shaft, the openings 96*b* and 97*b* of the crank pins 96 and 97 which are eccentric to the axis Ax90 are formed between the crank journal 92, and the crank journals 91 and 93, respectively, and the opening 99*b* of the crank pin 99 which is eccentric to the axis Ax90 is formed between the crank journal 94 and the crank journal 95. Therefore, when the crankshaft 90 rotates as indicated by the arrow C, the centrifugal force acts on oil inside the in-shaft oil passages 900-914, and the oil is supplied in an imbalanced state to the crank pins 96-99 which are eccentric to the axis Ax90.

Particularly, in recent years, low-viscosity oil is used in some cases for the purpose of improving the fuel efficiency of the engine, and when the temperature of the low-viscosity oil is increased due to the driving of the engine, oil in the in-shaft oil passages 902, 905, and 913 easily flows to the crank pins 96, 97, and 99 located radially outward, respectively. Therefore, when the low-viscosity oil is increased in the temperature, the hydraulic pressure may be lowered unless a load of an oil pump is increased.

SUMMARY OF THE DISCLOSURE

The present disclosure is made in view of the above situations, and one purpose thereof is to provide a crankshaft bearing structure, capable of securing an appropriate hydraulic pressure even when low-viscosity oil is used.

According to one aspect of the present disclosure, a crankshaft bearing structure is provided, which includes a crankshaft, a cylinder block, a first upper journal bearing and a first lower journal bearing, and a second upper journal bearing and a second lower journal bearing. The crankshaft extends in a given direction and includes a first crank journal, a second crank journal, and a crank pin.

The first crank journal and the second crank journal are disposed adjacent to each other having a gap therebetween in the given direction. The crank pin is disposed between the first crank journal and the second crank journal in the given direction.

The cylinder block has a first bearing part and a second bearing part disposed to surround radially outward of the first crank journal and the second crank journal, respectively, and configured to axially support the crankshaft to be rotatable. The first upper journal bearing and the first lower journal bearing are attached to an upper part and a lower part of the first crank journal, respectively, between the first crank journal and the first bearing part in a state where the crankshaft is rotatable.

The second upper journal bearing and the second lower journal bearing are attached to an upper part and a lower part of the second crank journal, respectively, between the second crank journal and the second bearing part in a state where the crankshaft is rotatable.

The cylinder block includes an oil passage. The first upper journal bearing and the second upper journal bearing include oil holes connected to the oil passage and configured to supply oil from the oil passage to between the first upper journal bearing and the first lower journal bearing, and the first crank journal, and between the second upper journal bearing and the second lower journal bearing, and the second crank journal, respectively.

The crankshaft includes an in-shaft oil passage configured to draw the oil from an outer circumferential surface of the second crank journal to an outer circumferential surface of the crank pin. The second upper journal bearing has, on an inner circumferential surface thereof, a circumferential groove connected to the oil hole and extending in a circumferential direction of the second upper journal bearing.

An inner circumferential surface of each of the first upper journal bearing and the first lower journal bearing is comprised of a surface of revolution created by a straight line, as a generatrix, in parallel with a rotational axis of the crankshaft. The oil is supplied to between the first upper journal bearing and the first lower journal bearing, and the first crank journal, only through a passage passing through the oil hole.

According to this structure, the oil holes are formed in both of the first upper journal bearing and the second upper journal bearing. Therefore, in the crankshaft bearing structure described above, as opposed to the structure disclosed in JP2015-034572A, oil is supplied from the oil passage to both of between the first upper journal bearing and the first lower journal bearing, and the first crank journal, and between the second upper journal bearing and the second lower journal bearing, and the second crank journal. Therefore, even when the centrifugal force acts on the oil inside the in-shaft oil passage due to the rotation of the crankshaft, an appropriate hydraulic pressure can be secured.

Further, part of the oil supplied to between the second upper and lower journal bearings and the second crank journal is supplied to the crank pin which is disposed between the first crank journal and the second crank journal, by flowing through the in-shaft oil passage formed to connect the outer circumferential surface of the second crank journal, to the outer circumferential surface of the crank pin. On the other hand, as for the first crank journal disposed on the opposite side from the second crank journal interposing the crank pin therebetween, oil is supplied to between the first crank journal and the first upper and lower journal bearings only from the passage through the oil hole formed in the first upper journal bearing. That is, the outer circumferential surface of the first crank journal is not connected with any in-shaft oil passage for receiving the oil supply from the adjacent crank pin. Therefore, even when the crankshaft rotates, the appropriate hydraulic pressure can be secured.

Further, the inner circumferential surface of the first upper journal bearing is comprised of the revolution surface created having the straight line in parallel with the rotational axis of the crankshaft as the generatrix. That is, the inner circumferential surface of the first upper journal bearing is not formed with a groove extending in the circumferential direction, but formed with the oil hole only. Also the inner circumferential surface of the first lower journal bearing is not formed with a circumferential groove. Therefore, even when the low-viscosity oil is used, the appropriate hydraulic pressure can be secured.

On the other hand, in the inner circumferential surface of the second upper journal bearing, the circumferential groove connected to the oil hole is formed. Therefore, a part of oil supplied from the oil hole of the second upper journal bearing can be favorably supplied to the in-shaft oil passage which is connected to the outer circumferential surface of the crank pin.

An inner circumferential surface of the second lower journal bearing may be comprised of a surface of revolution created by a straight line, as a generatrix, in parallel with the rotational axis of the crankshaft.

According to this structure, the inner circumferential surface of the second lower journal bearing is also comprised of the revolution surface created having the straight line in parallel with the rotational axis of the crankshaft as the generatrix. That is, also the inner circumferential surface of the second lower journal bearing is not formed with a circumferential groove. Therefore, according to this structure, the appropriate hydraulic pressure can be secured, while introducing a part of oil suppled from the oil hole formed in the second upper journal bearing to the in-shaft oil passage.

Suppose that the crank pin is a first crank pin and the in-shaft oil passage is a first in-shaft oil passage. In this case, the crankshaft may further include a third crank journal, a second crank pin, and a second in-shaft oil passage. The third crank journal may be disposed adjacent to the second crank journal having a gap therebetween on an opposite side from the first crank journal in the given direction. The second crank pin may be disposed between the second crank journal and the third crank journal in the given direction. The second in-shaft oil passage may draw the oil from the outer circumferential surface of the second crank journal to an outer circumferential surface of the second crank pin.

The cylinder block may further include a third bearing part disposed to surround radially outward of the third crank journal and configured to axially support the crankshaft to be rotatable. The crankshaft bearing structure may further include a third upper journal bearing and a third lower journal bearing attached to an upper part and a lower part of the third crank journal, respectively, between the third crank journal and the third bearing part in a state where the crankshaft is rotatable.

The third upper journal bearing may include an oil hole connected to the oil passage and configured to supply oil from the oil passage to between the third upper journal bearing and the third lower journal bearing, and the third crank journal, and an inner circumferential surface comprised of a surface of revolution created by a straight line, as a generatrix, in parallel with the rotational axis of the crankshaft.

The oil may be supplied to between the third upper journal bearing and the third lower journal bearing, and the third crank journal, only through a passage passing through the oil hole.

According to this structure, the oil hole is also formed in the third upper journal bearing so that oil is directly supplied from the oil passage to between the third upper journal bearing and the third lower journal bearing, and the third crank journal. Further, an outer circumferential surface of the third crank journal is not connected with any in-shaft oil passage for receiving the oil supply from the adjacent crank pin. Therefore, even when the centrifugal force acts on the oil inside the in-shaft oil passage due to the rotation of the crankshaft, the appropriate hydraulic pressure can be secured.

Moreover, the outer circumferential surface of the second crank pin which is disposed between the second crank journal and the third crank journal in the given direction, is connected with the second in-shaft oil passage which connects between the outer circumferential surface of the second crank pin and the outer circumferential surface of the second crank journal. Therefore, a part of the oil supplied to between the second upper and lower journal bearings and the second crank journal is also supplied to the outer circumferential surface of the second crank pin, by flowing through the second in-shaft oil passage. As a result, the appropriate hydraulic pressure can be secured.

The crank pin may include, on the outer circumferential surface thereof, an opening provided as an end of the in-shaft oil passage.

According to this structure, the opening as the end of the in-shaft oil passage is formed on the outer circumferential surface of the crank pin. Thus, even when the centrifugal force acts on the oil inside the in-shaft oil passage due to the rotation of the crankshaft, a part of the oil supplied to between the second upper and lower journal bearings and the second crank journal, is supplied to between the crank pin and a connecting rod bearing attached around the crank pin. Therefore, this structure is further suitable for securing the appropriate hydraulic pressure.

Furthermore, according to this structure, since the end of the in-shaft oil passage is the opening formed on the outer circumferential surface of the crank pin, unlike the structure disclosed in JP2015-034572A, the in-shaft oil passage does not further extend to the adjacent first crank journal. Therefore, according to this structure, even when the centrifugal force acts due to the rotation of the crankshaft, the appropriate hydraulic pressure can be secured.

DETAILED DESCRIPTION OF THE DISCLOSURE

Figure 1:
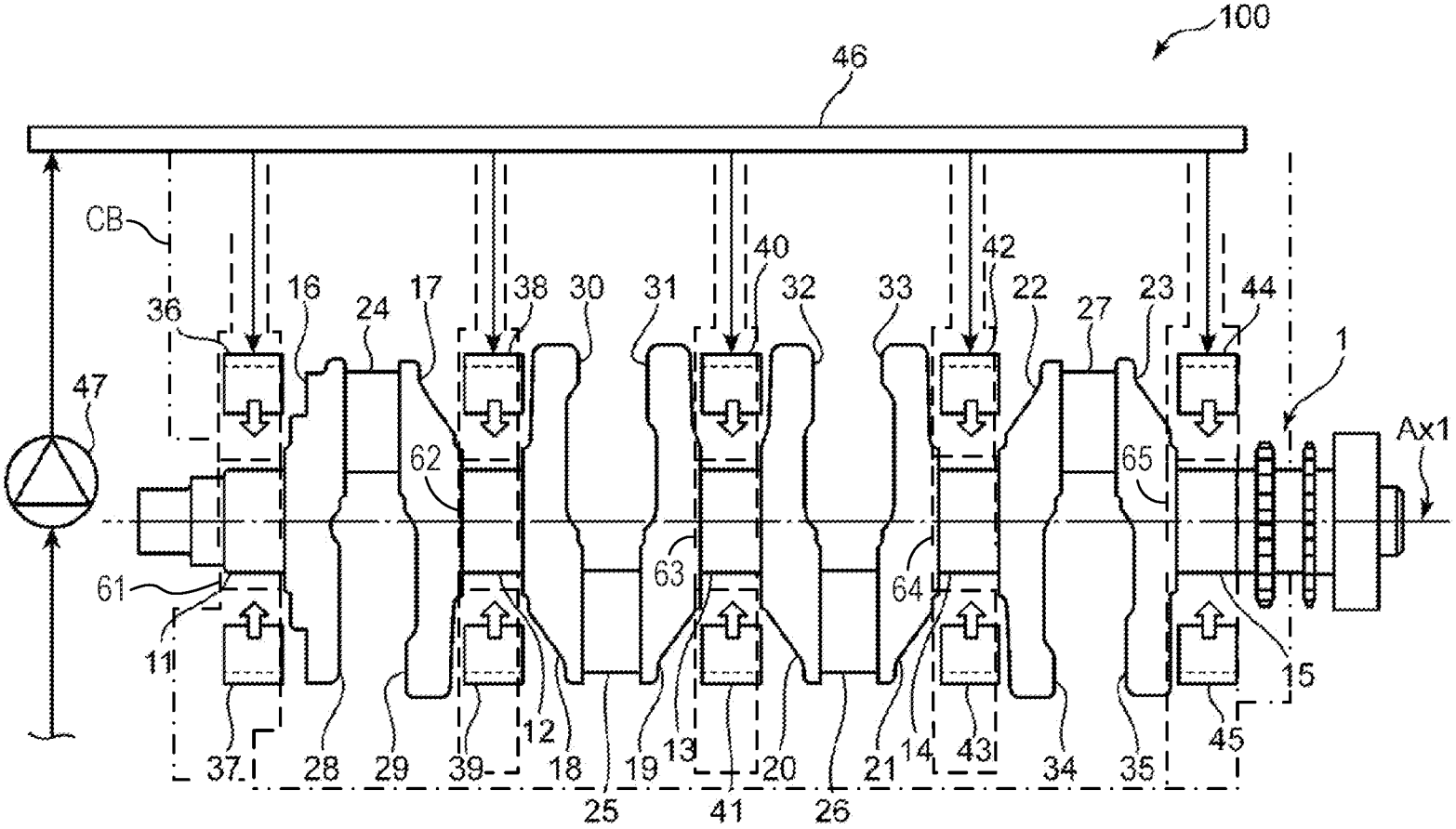
FIG. 1 is a schematic diagram illustrating a crankshaft bearing structure according to one embodiment.

Hereinafter, one embodiment of the present disclosure is described with reference to the accompanying drawings. Note that the following embodiment is one example of the present disclosure, and the present disclosure, except for essential components thereof, is not limited by the following embodiment.

1. Outline Configuration of Crankshaft Bearing Structure 100

An outline configuration of a crankshaft bearing structure 100 according to this embodiment is described with reference to FIG. 1. The crankshaft bearing structure 100 includes a cylinder block CB (dash-dotted line) having bearing parts (a first bearing part 61, a second bearing part 62, a third bearing part 63, a fourth bearing part 64, and a fifth bearing part 65, shown as long dashed lines). Further, illustration of connecting rods and connecting rod bearings which are connected to a crankshaft 1 is also omitted.

As illustrated in FIG. 1, the crankshaft bearing structure 100 is provided with the crankshaft 1 and a plurality of journal bearings 36-45. Moreover, the crankshaft bearing structure 100 is provided with an oil gallery (oil passage) 46 formed in the cylinder block CB, and an oil pump 47 which sends oil to the oil gallery 46.

The crankshaft 1 extends along an axis Ax1, and in this embodiment, an extending direction of the axis Ax1 is a direction in which cylinders of an engine are lined up, and is an example of a "given direction." The crankshaft 1 includes a plurality of crank journals 11-15 which are arranged in the axis Ax1 direction having a gap therebetween. Moreover, the crankshaft 1 includes crank pins 24-27 each located between the adjacent crank journals 11-15 in the axis Ax1 direction.

In the crankshaft 1, the crank journals 11-15 and the crank pins 24-27 adjacent to each other in the axis Ax1 direction are connected by crank webs 16-23 extending in a direction intersecting with the axis Ax1, respectively. The crank pins 24-27 are connected to tip end parts of the corresponding crank webs 16-23, and center axes of the crank pins 24-27 are eccentric relative to the axis Ax1. The crank webs 16-23 are integrally formed, at the other end parts, with counterweights 28-35, respectively.

Note that, herein, the crank journal 11, the crank journal 12, the crank journal 13, the crank journal 14, and the crank journal 15 may be referred to as "#1 crank journal, #2 crank journal, #3 crank journal, #4 crank journal, and #5 crank journal," respectively.

The journal bearings 36-45 are interposed between the bearing parts 61-65 of the cylinder block CB and the crank journals 11-15, respectively. Each of the journal bearings 36-45 has a semi-annular (half-ring) shape in a front view (seen in the axis Ax1 direction). The journal bearings 36-45 are plain bearings made of metal material. Note that the journal bearings 36, 38, 40, 42, and 44 are upper journal bearings which are disposed at the upper side (i.e., a cylinder head side) of the engine, and cover upper semi-perimeters of the crank journals 11-15, respectively. On the other hand, the journal bearings 37, 39, 41, 43, and 45 are lower journal bearings which are disposed at the lower side (i.e., an oil pan side) of the engine, and cover lower semi-perimeters of the crank journals 11-15, respectively.

The upper journal bearing 36 and the lower journal bearing 37 are attached around the #1 crank journal 11, the upper journal bearing 38 and the lower journal bearing 39 are attached around the #2 crank journal 12, the upper journal bearing 40 and the lower journal bearing 41 are attached around the #3 crank journal 13, the upper journal bearing 42 and the lower journal bearing 43 are attached around the #4 crank journal 14, and the upper journal bearing 44 and the lower journal bearing 45 are attached around the #5 crank journal 15. Note that the #1 crank journal 11 is an example of a "first crank journal," the #2 crank journal 12 is an example of a "second crank journal,"

and the #3 crank journal 13 is an example of a "third crank journal" in the present disclosure.

Further, the upper journal bearing 36 is an example of a "first upper journal bearing," the lower journal bearing 37 is an example of a "first lower journal bearing," the upper journal bearing 38 is an example of a "second upper journal bearing," the lower journal bearing 39 is an example of a "second lower journal bearing," the upper journal bearing 40 is an example of a "third upper journal bearing," and the lower journal bearing 41 is an example of a "third lower journal bearing" in the present disclosure.

Fine gaps are formed between the journal bearings 36-45 and the crank journals 11-15 such that the crankshaft 1 is rotatable about the axis Ax1 and oil film is formable therein. As an oil supply port for the formation of the oil film, an oil hole connected to the oil gallery 46 is formed in each of the upper journal bearings 36, 38, 40, 42, and 44. That is, in the crankshaft bearing structure 100 according to this embodiment, oil is supplied to between the journal bearings 36-45 and the crank journals 11-15 through the oil holes formed in all of the upper journal bearings 36, 38, 40, 42, and 44, respectively.

The oil gallery 46 is an oil passage formed in the cylinder block CB, and is connected to the oil pump 47 which supplies oil in the oil pan to the oil gallery 46. Note that in this embodiment so-called low-viscosity oil is adopted as the oil. In detail, oil of 0W-8 to 0W-30 in the SAE (Society of Automotive Engineers, Inc.) grade is adopted.

2. In-shaft Oil Passages 48-53 of Crankshaft 1

The crankshaft 1 according to this embodiment has in-shaft oil passages 48-53 which are oil passages formed inside the shaft. The in-shaft oil passages 48-53 of the crankshaft 1 are described with reference to FIG. 2.

Figure 2:
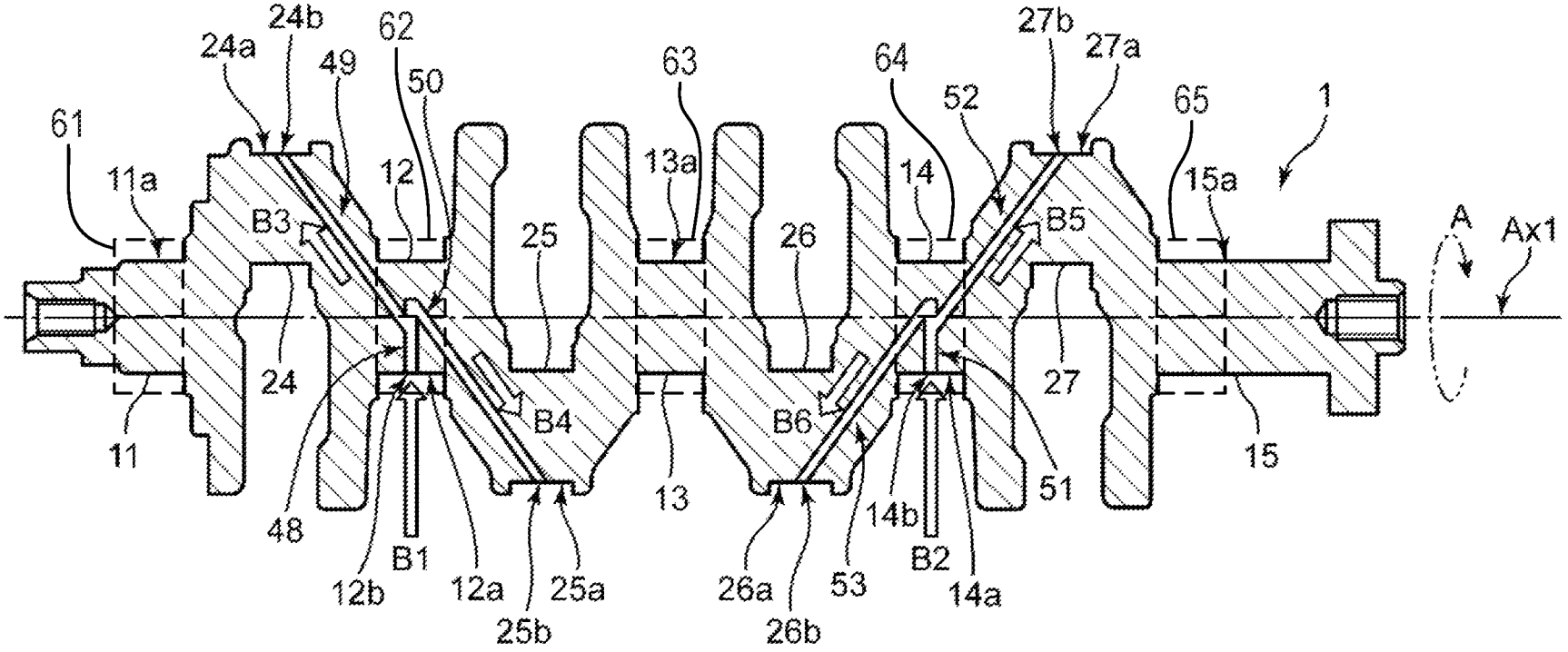
FIG. 2 is a cross-sectional view illustrating a structure of in-shaft oil passages of a crankshaft.

As illustrated in FIG. 2, an opening is not formed in outer circumferential surfaces 11*a*, 13*a*, and 15*a* of the #1, #3, and #5 crank journals 11, 13, and 15. On the other hand, openings 12*b* and 14*b* are formed in outer circumferential surfaces 12*a* and 14*a* of the #2 and #4 crank journals 12 and 14, respectively. The opening 12*b* is an opening from which oil is entered into the in-shaft oil passage 48, and the opening 14*b* is an opening from which oil is entered into the in-shaft oil passage 51.

The in-shaft oil passage 48 is formed to extend perpendicularly to the axis Ax1 of the crankshaft 1 from the outer circumferential surface 12*a* of the crank journal 12. Inside the crankshaft 1, the in-shaft oil passage 48 is connected to the two in-shaft oil passages 49 and 50 which are formed to extend obliquely to the axis Ax1 of the crankshaft 1.

The in-shaft oil passage 49 is formed such that an opening 24*b* formed in an outer circumferential surface 24*a* of the crank pin 24 is an end of the in-shaft oil passage 49. The in-shaft oil passage 50 is formed such that an opening 25*b* formed in an outer circumferential surface 25*a* of the crank pin 25 is an end of the in-shaft oil passage 50. That is, in the crankshaft 1 according to this embodiment, an in-shaft oil passage from the outer circumferential surface 24*a* of the crank pin 24 to the crank journal 11 is not formed, and an in-shaft oil passage from the outer circumferential surface 25*a* of the crank pin 25 to the crank journal 13 is not formed.

The in-shaft oil passage 51 is formed to extend perpendicularly to the axis Ax1 of the crankshaft 1 from the outer circumferential surface 14*a* of the crank journal 14. Inside the crankshaft 1, the in-shaft oil passage 51 is connected to the two in-shaft oil passages 52 and 53 which are formed to extend obliquely to the axis Ax1 of the crankshaft 1.

The in-shaft oil passage 52 is formed such that an opening 27*b* formed in an outer circumferential surface 27*a* of the crank pin 27 is an end of the in-shaft oil passage 52. The in-shaft oil passage 53 is formed such that an opening 26*b* formed in an outer circumferential surface 26*a* of the crank pin 26 is an end of the in-shaft oil passage 53. That is, in the crankshaft 1 according to this embodiment, an in-shaft oil passage from the outer circumferential surface 27*a* of the crank pin 27 to the crank journal 15 is not formed, and an in-shaft oil passage from the outer circumferential surface 26*a* of the crank pin 26 to the crank journal 13 is not formed.

Part of oil supplied from the oil gallery 46 to between the #2 crank journal 12, and the journal bearings 38 and 39 is introduced into the in-shaft oil passage 48 as indicated by an arrow B1. Then, as indicated by arrows B3 and B4, the supplied oil is distributed to, and flows through the in-shaft oil passages 49 and 50 connected to the in-shaft oil passage 48 inside the crankshaft 1, and passes through the openings 24*b* and 25*b* of the crank pins 24 and 25 so as to be supplied to between the crank pins 24 and 25 and the connecting rod bearings, respectively.

Note that with the crankshaft bearing structure 100 according to this embodiment, in-shaft oil passages are not formed between the outer circumferential surface 24*a* of the crank pin 24 and the #1 crank journal 11, and between the outer circumferential surface 25*a* of the crank pin 25 and the #3 crank journal 13. Therefore, even when the crankshaft 1 rotates as indicated by an arrow A, the oil supplied to between the journal bearings 36 and 37 and the #1 crank journal 11, and between the journal bearings 40 and 41 and the #3 crank journal 13 is not drawn to the crank pins 24 and 25, respectively.

A part of oil supplied from the oil gallery 46 to between the #4 crank journal 14, and the journal bearings 42 and 43 is introduced into the in-shaft oil passage 51 as indicated by an arrow B2. Then, as indicated by arrows B5 and B6, the supplied oil is distributed to, and flows through the in-shaft oil passages 52 and 53 connected to the in-shaft oil passage 51 inside the crankshaft 1, and passes through the openings 26*b* and 27*b* of the crank pins 26 and 27 so as to be supplied to between the crank pins 26 and 27 and the connecting rod bearings, respectively.

Note that, similarly to above, with the crankshaft bearing structure 100 according to this embodiment, in-shaft oil passages are not formed between the outer circumferential surface 27*a* of the crank pin 27 and the #5 crank journal 15, and between the outer circumferential surface 26*a* of the crank pin 26 and the #3 crank journal 13. Therefore, even when the crankshaft 1 rotates as indicated by the arrow A, the oil supplied to between the journal bearings 40 and 41 and the #3 crank journal 13, and between the journal bearings 44 and 45 and the #5 crank journal 15 is not drawn to the crank pins 26 and 27, respectively.

3. Detailed Structure of Journal Bearings 36-45

A detailed structure of the journal bearings 36-45 is described with reference to FIGS. 3A, 3B, 4A, and 4B.

In the crankshaft bearing structure 100 according to this embodiment, the journal bearings 38, 39, 42, and 43 which are attached around the #2 and #4 crank journals 12 and 14 formed with the openings 12*b* and 14*b* on the outer circumferential surfaces 12*a* and 14*a*, respectively, are different in a part of their structures from the journal bearings 36, 37, 40, 41, 44, and 45 which are attached around the #1, #3, and #5 crank journals 11, 13, and 15 without openings on the outer circumferential surfaces 11*a*, 13*a*, and 15*a*, respectively.

Figure 3B:
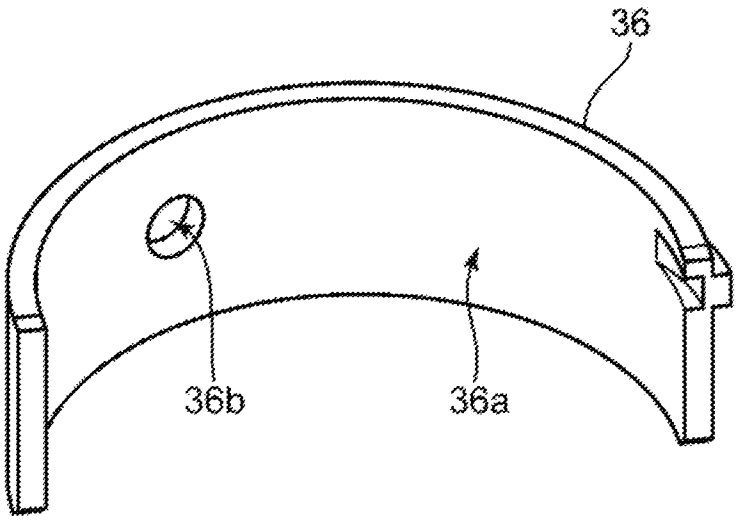
FIG. 3B is a perspective view illustrating a structure of an inner circumferential surface of the upper journal bearing.
Figure 3A:
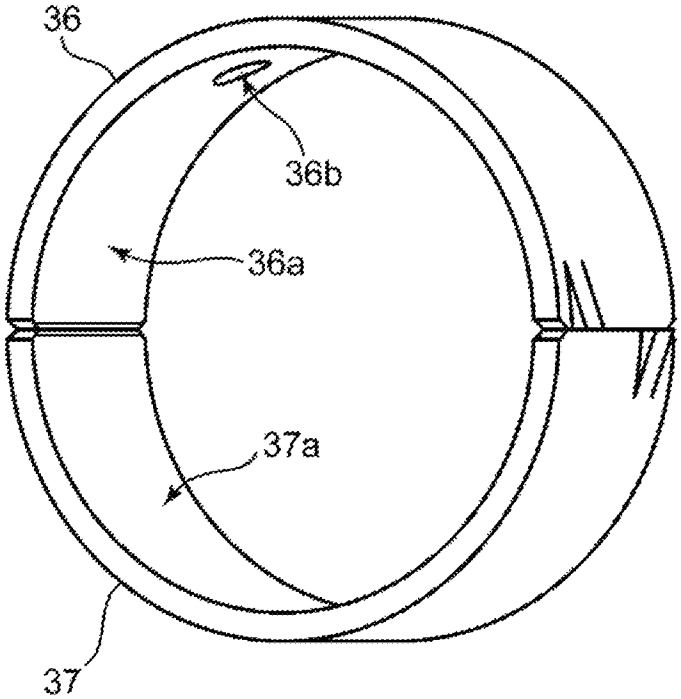
FIG. 3A is a perspective view illustrating a structure of upper and lower journal bearings which are attached around a #1 crank journal.
Figure 4B:
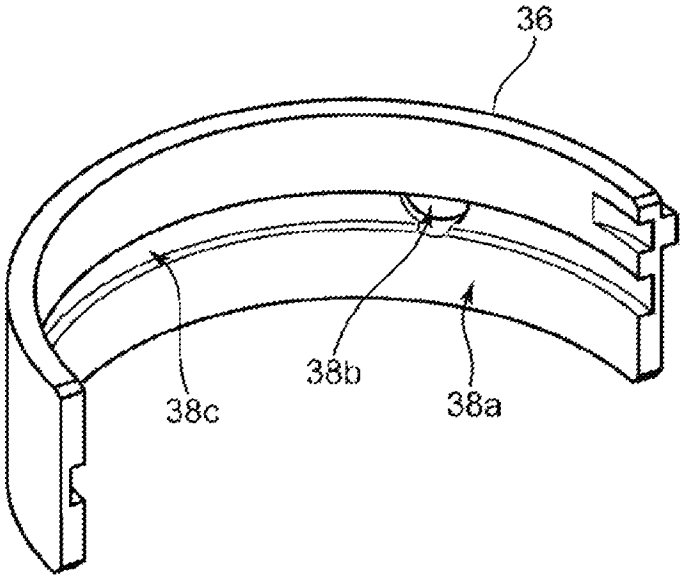
FIG. 4B is a perspective view illustrating a structure of an inner circumferential surface of the upper journal bearing.
Figure 4A:
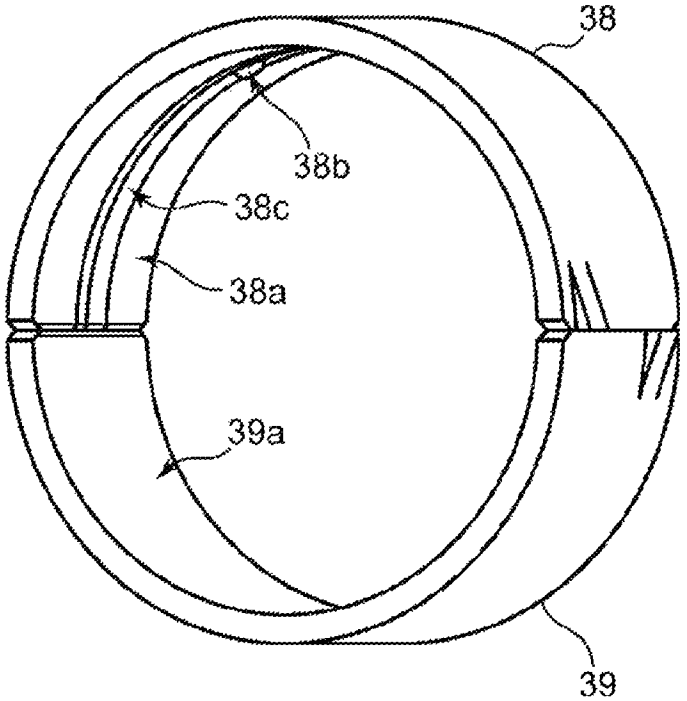
FIG. 4A is a perspective view illustrating a structure of upper and lower journal bearings which are attached around a #2 crank journal.

FIG. 3A illustrates the journal bearings 36 and 37 as one example of the journal bearings which are attached around the #1, #3, and #5 crank journals 11, 13, and 15, and FIG. 4A illustrates the journal bearings 38 and 39 as one example of the journal bearings which are attached around the #2 and #4 crank journals 12 and 14. Note that FIG. 3B is a perspective view illustrating an inner circumferential surface 36*a* of the upper journal bearing 36, and FIG. 4B is a perspective view illustrating an inner circumferential surface 38*a* of the upper journal bearing 38.

As illustrated in FIG. 3A, each of the upper journal bearing 36 and the lower journal bearing 37 which are attached around the #1 crank journal 11, has a semi-annular shape in a front view (in the extending direction of the axis Ax1). The upper journal bearing 36 and the lower journal bearing 37 are attached around the #1 crank journal 11 in a state where their circumferential end parts abut against each other.

As illustrated in FIGS. 3A and 3B, the upper journal bearing 36 is formed, at a part near its top, with an oil hole 36*b*. As described above with reference to FIG. 1, the oil hole 36*b* of the upper journal bearing 36 is connected to the oil gallery 46, and oil is supplied from the oil gallery 46 to between the journal bearings 36 and 37 and the #1 crank journal 11 through the oil hole 36*b*.

The inner circumferential surface 36*a* and an inner circumferential surface 37*a* of the upper journal bearing 36 and the lower journal bearing 37 which are attached around the #1 crank journal 11 are each formed by a surface of revolution created by a straight line, as the generatrix, in parallel with the axis Ax1 of the crankshaft 1 (see FIGS. 1 and 2). That is, the upper journal bearing 36 and the lower journal bearing 37 are not formed, on the inner circumferential surfaces 36*a* and 37*a*, with a groove extending in a circumferential direction (circumferential groove), and the inner circumferential surfaces 36*a* and 37*a* are formed to be smooth curved surfaces.

Note that the journal bearings 40 and 41 which are attached around the #3 crank journal 13, and the journal bearings 44 and 45 which are attached around the #5 crank journal 15, also have a structure similar to the journal bearings 36 and 37.

As illustrated in FIG. 4A, each of the upper journal bearing 38 and the lower journal bearing 39 which are attached around the #2 crank journal 12, also has a semi-annular shape in the front view (in the extending direction of the axis Ax1). As illustrated in FIGS. 4A and 4B, the upper journal bearing 38 is also formed, at a part near its top, with an oil hole 38*b*. The oil hole 38*b* is also connected to the oil gallery 46, and oil is supplied from the oil gallery 46 to between the journal bearings 38 and 39 and the crank journal 12 through the oil hole 38*b*.

Among the upper journal bearing 38 and the lower journal bearing 39 which are attached around the #2 crank journal 12, the lower journal bearing 39 has, as an inner circumferential surface 39*a*, a surface of revolution created by a straight line, as the generatrix, in parallel with the axis Ax1 of the crankshaft 1 (see FIGS. 1 and 2). That is, the lower journal bearing 39 is not formed, on the inner circumferential surface 39*a*, with a groove extending in the circumferential direction (circumferential groove), and the inner circumferential surface 39*a* is formed to be a smooth curved surface.

On the other hand, as illustrated in FIGS. 4A and 4B, in the upper journal bearing 38 formed with the oil hole 38*b*, a circumferential groove 38*c* extending in the circumferential direction of the inner circumferential surface 38*a* is formed. The circumferential groove 38*c* is connected to the oil hole 38*b*, and formed from one end part at a circumferentially one side to an end part on the other side. The circumferential groove 38*c* formed in the upper journal bearing 38 functions as a guiding passage of oil supplied from the oil hole 38*b*.

Note that the journal bearings 42 and 43 attached around the #4 crank journal 14 also have a structure similar to the journal bearings 38 and 39.

4. Oil Flow Between Journal Bearings 36-45 and Crank Journals 11-15

A flow of oil between the journal bearings 36-45 and the crank journals 11-15 is described with reference to FIGS. 5A and 5B. Note that FIG. 5A illustrates a flow of oil between the journal bearings 36 and 37, and the #1 crank journal 11 as one example of a flow of oil between the journal bearings 36, 37, 40, 41, 44, and 45, and the #1, #3, and #5 crank journals 11, 13, and 15. Further, FIG. 5B illustrates a flow of oil between the journal bearings 38 and 39, and the #2 crank journal 12 as one example of a flow of oil between the journal bearings 38, 39, 42, and 43, and the #2 and #4 crank journals 12 and 14.

As illustrated in FIG. 5A, between the #1 crank journal 11 without an opening formed in the outer circumferential surface 11*a* to be connected to an in-shaft oil passage, and the journal bearings 36 and 37 attached to the #1 crank journal 11, oil is supplied through the hole 36*b* formed in the upper journal bearing 36 (see an arrow F1). Then, the supplied oil lubricates between the inner circumferential surfaces 36*a* and 37*a* of the journal bearings 36 and 37, and the outer circumferential surface 11*a* of the #1 crank journal 11, and is discharged outside only from end parts (end parts in the axis Ax1 direction of the crankshaft 1) of the journal bearings 36 and 37 (see arrows F2).

Note that the oil flow between the journal bearings 40 and 41, and the #3 crank journal 13, and between the journal bearings 44 and 45, and the #5 crank journal 15 is also similar to the oil flow described with reference to FIG. 5A.

Figure 5B:
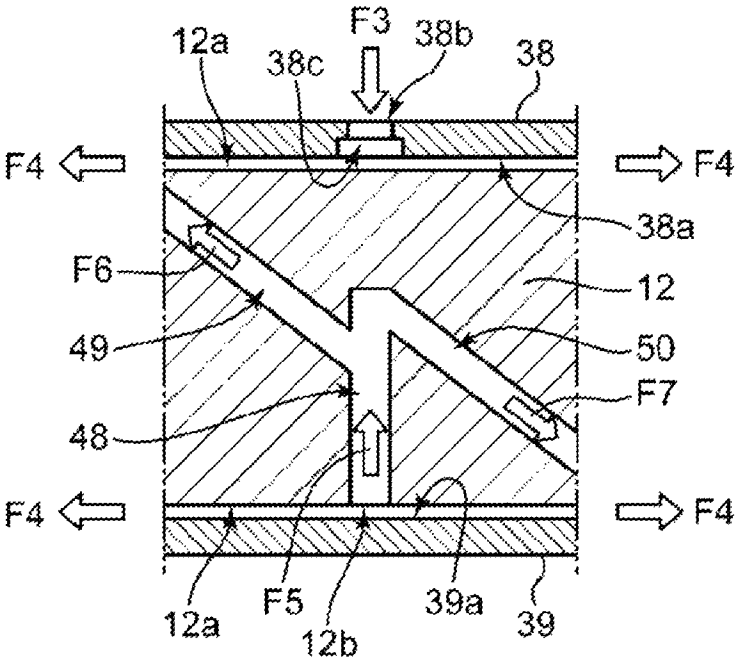
FIG. 5B is a cross-sectional view illustrating a flow of oil between the #2 crank journal and the journal bearing.
Figure 5A:
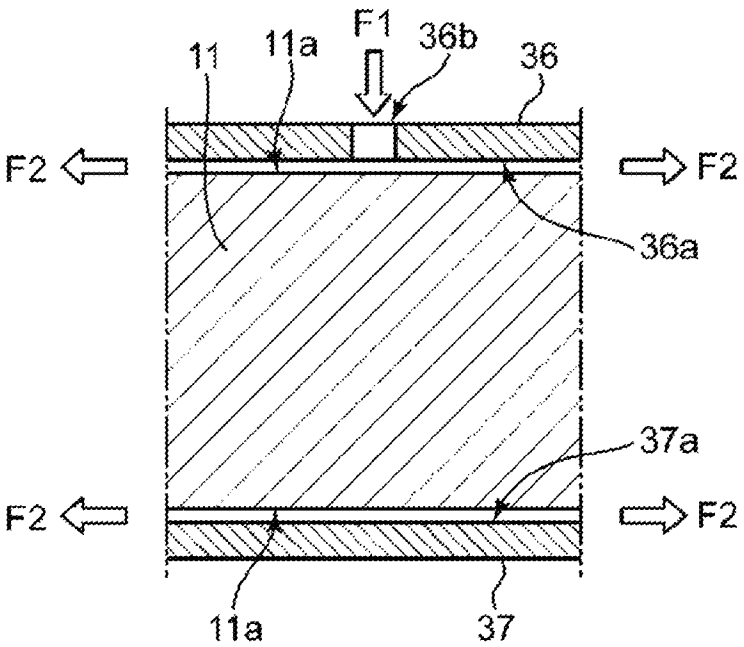
FIG. 5A is a cross-sectional view illustrating a flow of oil between the #1 crank journal and the journal bearing.
Figure 6:
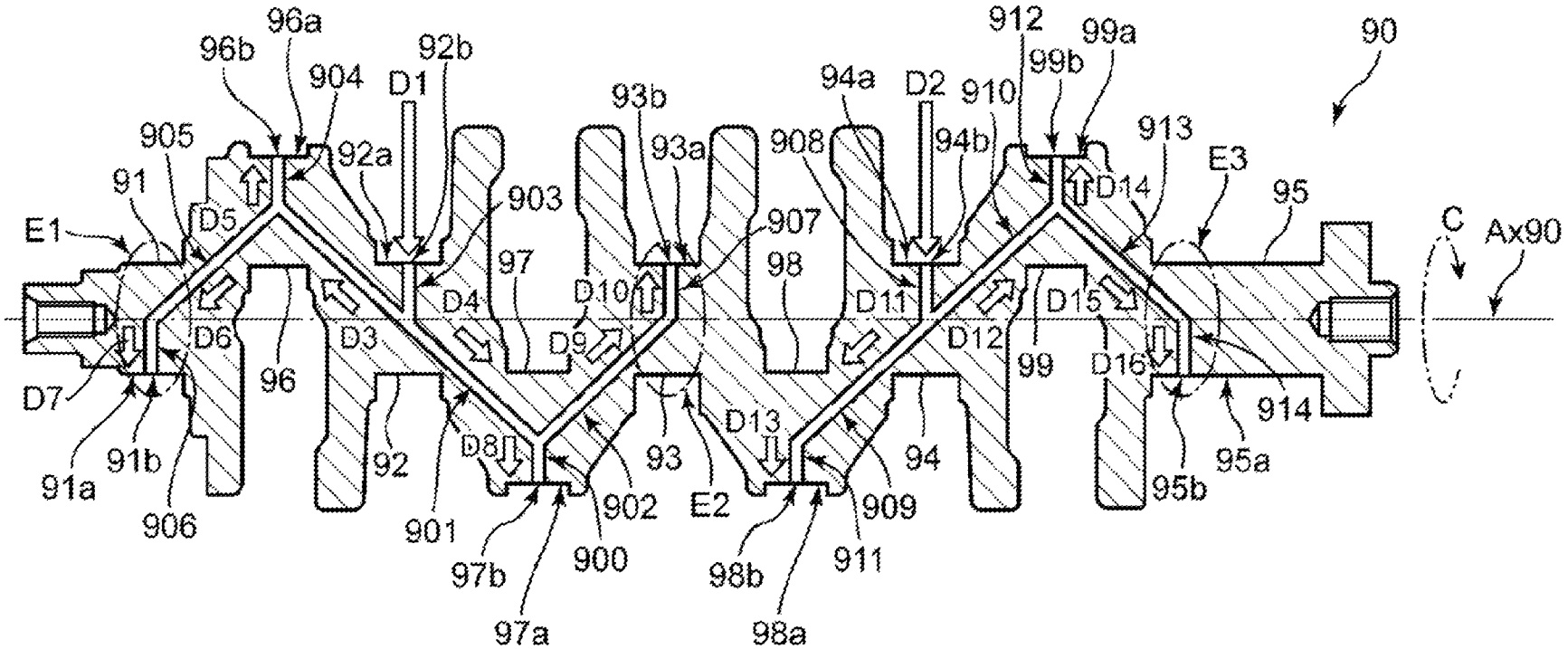
FIG. 6 CONVENTIONAL ART
FIG. 6 is a cross-sectional view illustrating a structure of in-shaft oil passages of a crank shaft according to a conventional art.

As illustrated in FIG. 5B, also between the #2 crank journal 12 with the opening 12*b* formed in the outer circumferential surface 12*a* to be connected to the in-shaft oil passage 48, and the journal bearings 38 and 39 attached to the #2 crank journal 12, oil is supplied through the hole 38*b* formed in the upper journal bearing 38 (see an arrow F3). Then, the supplied oil lubricates between the inner circumferential surfaces 38*a* and 39*a* of the journal bearings 38 and 39, and the outer circumferential surface 12*a* of the #2 crank journal 12, and part of the oil is discharged outside from end parts (end parts in the axis Ax1 direction of the crankshaft 1) of the journal bearings 38 and 39 (see arrows F4).

Moreover, the rest of oil supplied to between the journal bearings 38 and 39, and the #2 crank journal 12 is introduced into the in-shaft oil passage 48 from the opening 12*b* formed in the outer circumferential surface 12*a* of the #2 crank journal 12 (see an arrow F5). The oil supplied to the in-shaft oil passage 48 is distributed to the in-shaft oil passage 49 and the in-shaft oil passage 50 connected to the in-shaft oil passage 48, and supplied to the crank pins 24 and 25 adjacent to the #2 crank journal 12 in the axis Ax1 direction (see arrows F6 and F7). Note that since the circumferential groove 38*c* connected to the oil hole 38*b* and extending in the circumferential direction is formed in the upper journal bearing 38, the oil is favorably introduced into the in-shaft oil passage 48.

Note that the flow of oil supplied to between the journal bearings 42 and 43, and the #4 crank journal 14 is similar to the oil flow described with reference to FIG. 5B.

5. Effects

In the crankshaft bearing structure 100 according to this structure, the oil holes (36*b*, 38*b*) are formed in all of the upper journal bearings 36, 38, 40, 42, and 44, respectively. Therefore, in the crankshaft bearing structure 100, different from the structure disclosed in JP2015-034572A, oil is supplied from the oil gallery 46 to all of between the journal bearings 36-45 and the #1-5 crank journals 11-15 through the oil holes (36*b*, 38*b*). Therefore, even when the centrifugal force acts on the oil inside the in-shaft oil passages 48-53 due to the rotation of the crankshaft 1 (as indicated by the arrow A in FIG. 2), an appropriate hydraulic pressure can be secured.

Further, a part of the oil supplied to between the journal bearings 38, 39, 42, and 43, and the #2 and #4 crank journals 12 and 14 is supplied to the crank pins 24-27 by passing through the in-shaft oil passages 48-53 formed to connect the outer circumferential surfaces 12*a* and 14*a* of the #2 and #4 crank journals 12 and 14, to the outer circumferential surfaces 24*a*, 25*a*, 26*a*, and 27*a* of the crank pins 24-27, respectively.

On the other hand, as for the #1, #3, and #5 crank journals 11, 13, and 15, oil is supplied to between the #1, #3, and #5 crank journals 11, 13, and 15, and the journal bearings 36, 37, 40, 41, 44, and 45 only from the passages through the oil holes (36*b*) formed in the upper journal bearings 36, 40, and 44, respectively. That is, in-shaft oil passages are not connected between the outer circumferential surfaces 11*a*, 13*a*, and 15*a* of the #1, #3, and #5 crank journals 11, 13, and 15, and the adjacent crank pins 24-27. Therefore, even when the crankshaft 1 rotates (as indicated by the arrow A in FIG. 2), the appropriate hydraulic pressure can be secured.

Further, the inner circumferential surfaces (36*a*, 37*a*) of the journal bearings 36, 37, 40, 41, 44, and 45 which are attached around the #1, #3, and #5 crank journals 11, 13, and 15, respectively, are each comprised of the revolution surface created by the straight line (generatrix) in parallel with the rotational axis (axis Ax1) of the crankshaft 1. That is, the inner circumferential surfaces (36*a*, 37*a*) of the journal bearings 36, 37, 40, 41, 44, and 45 are not formed with a groove extending in the circumferential direction. Therefore, even when the low-viscosity oil is used, the appropriate hydraulic pressure can be secured.

On the other hand, in the inner circumferential surfaces (38*a*) of the upper journal bearings 38 and 42 attached to the #2 and #4 crank journals 12 and 14, the circumferential grooves (38*c*) connected to the oil holes (38*b*) are formed, respectively. Therefore, a part of oil supplied from the oil holes (38*b*) of the upper journal bearings 38 and 42 can be favorably supplied to the in-shaft oil passages 48-53 which are connected to the outer circumferential surfaces 24*a*, 25*a*, 26*a*, and 27*a* of the crank pins 24-27, respectively.

Note that the circumferential grooves (38*c*) extending in the circumferential direction are formed in the inner circumferential surfaces (38*a*) of the upper journal bearings 38 and 42 which are attached to the #2 and #4 crank journals 12 and 14, respectively. The circumferential grooves (38*c*) function as passages to introduce the oil supplied through the oil holes (38*b*) to the entire circumference between the journal bearings 38, 39, 42, and 43, and the #2 and #4 crank journals 12 and 14, respectively. In addition, the circumferential grooves (38*c*) also function as guiding passages to discharge particulate foreign matters (e.g., metallic powder) which entered into between the journal bearings 38, 39, 42, and 43, and the #2 and #4 crank journals 12 and 14 together with the oil, to outside therefrom.

Modifications

As described above, particulate foreign matter may be entered into between the journal bearing and the crank journal together with oil supplied through the oil hole. When such entered particulate foreign matters remain between the journal bearing and the crank journal, the inner circumferential surface of the journal bearing, and the outer circumferential surface of the crank journal may be damaged, or galling or seizure may be caused. Therefore, the particulate foreign matter entered into between the journal bearing and the crank journal need to be discharged therefrom to outside. In this respect, the following configuration can be adopted.

(1) A recess part is formed in the outer circumferential surface of the crank journal at a part in the circumferential direction. For example, the recess part may be a dotted recess part, or a recess part extending in the axial direction of the crankshaft in the plan view seen from radially outward of the crank journal. The particulate foreign matter are collected at the recess part by the rotation of the crankshaft.

Further, in order to discharge the particulate foreign matters collected at the recess part to outside, a groove extending in the axial direction of the crankshaft is provided to at least one of the upper journal bearing and the lower journal bearing. By the groove being provided to the journal bearing as described above, the particulate foreign matters collected at the recess part are guided to the groove of the journal bearing, and discharged outside with the oil flow.

(2) A groove is provided to the inner circumferential surface of the upper journal bearing so as to be connected to the oil hole and extend to one of both ends of the journal bearing in the axial direction of the crankshaft. Note that the groove is desired to be formed on a reverse side of the oil hole in the rotational direction of the crank journal.

By the groove being provided to the inner circumferential surface of the upper journal bearing as described above, the particulate foreign matters entered from the oil hole together with oil can be collected at the groove, and discharged outside from the groove end with the oil flow.

Note that when such groove is provided to the inner circumferential surface of the upper journal bearing, considering the adoption of low-viscosity oil, the upper journal bearing should be based on the upper journal bearing 36 without a circumferential groove formed on the inner circumferential surface 36*a* as illustrated in FIG. 3B, rather than the upper journal bearing 38 formed with the circumferential groove 38*c* on the inner circumferential surface 38*a* as illustrated in FIG. 4B.

Other Modifications

Although in the embodiment a four-cylinder engine is adopted as one example, and the crankshaft 1 includes five crank journals 11-15, the present disclosure is not limited to the configuration. For example, the engine may include two or three cylinders, or five or more cylinders.

Moreover, although in the embodiment the #1, #3, and #5 crank journals 11, 13, and 15 are not connected to the in-shaft oil passages, and the #2 and #4 crank journals 12 and 14 are connected to the in-shaft oil passages 48-53, the present disclosure is not limited to the configuration. For example, the #1, #3, and #5 crank journals may be connected to the in-shaft oil passages, and the #2 and #4 crank journals may not be connected to the in-shaft oil passages. Note that when such a configuration is adopted, the circumferential grooves may be formed in the upper journal bearings which are attached to the #1, #3, and #5 crank journals, respectively, and the circumferential grooves may not be formed in the upper journal bearings which are attached to the #2 and #4 crank journals, respectively.

Further, although in the embodiment the in-shaft oil passage 49 and the in-shaft oil passage 50 are branched from the in-shaft oil passage 48, and the in-shaft oil passage 52 and the in-shaft oil passage 53 are branched from the in-shaft oil passage 51, the present disclosure is not limited to the configuration. For example, two openings may be formed in the outer circumferential surface of a sole crank journal, and the in-shaft oil passages may be formed to extend from the respective openings.

It should be understood that the embodiments herein are illustrative and not restrictive, since the scope of the invention is defined by the appended claims rather than by the description preceding them, and all changes that fall within metes and bounds of the claims, or equivalence of such metes and bounds thereof, are therefore intended to be embraced by the claims.

DESCRIPTION OF REFERENCE CHARACTERS

1 Crankshaft
11-15 Crank Journal
11*a*, 12*a*, 13*a*, 14*a*, 15*a* Outer Circumferential Surface
12*b*, 14*b* Opening
24-27 Crank Pin
24*a*, 25*a*, 26*a*, 27*a* Outer Circumferential Surface
24*b*, 25*b*, 26*b*, 27*b* Opening
36, 38, 40, 43, 44 Upper Journal Bearing
36*a*, 37*a*, 38*a*, 39*a* Inner Circumferential Surface
36*b*, 38*b* Oil Hole
37, 39, 41, 43, 45 Lower Journal Bearing
38*c* Circumferential Groove
46 Oil Gallery (Oil Passage)
48-53 In-shaft Oil Passage
100 Crankshaft Bearing Structure

What is claimed is:

1. A crankshaft bearing structure, comprising:

a crankshaft extending in a given direction and including a first crank journal and a second crank journal disposed adjacent to each other having a gap therebetween in the given direction, and a crank pin disposed between the first crank journal and the second crank journal in the given direction;

a cylinder block having a first bearing part and a second bearing part disposed to surround radially outward of the first crank journal and the second crank journal, respectively, and configured to axially support the crankshaft to be rotatable;

a first upper journal bearing and a first lower journal bearing attached to an upper part and a lower part of the first crank journal, respectively, between the first crank journal and the first bearing part in a state where the crankshaft is rotatable; and a second upper journal bearing and a second lower journal bearing attached to an upper part and a lower part of the second crank journal, respectively, between the second crank journal and the second bearing part in a state where the crankshaft is rotatable, wherein the cylinder block includes an oil passage, wherein the first upper journal bearing and the second upper journal bearing include oil holes connected to the oil passage and configured to supply oil from the oil passage to between the first upper journal bearing and the first lower journal bearing, and the first crank journal, and between the second upper journal bearing and the second lower journal bearing, and the second crank journal, respectively, wherein the crankshaft includes an in-shaft oil passage configured to draw the oil from an outer circumferential surface of the second crank journal to an outer circumferential surface of the crank pin, wherein the second upper journal bearing has, on an inner circumferential surface thereof, a circumferential groove connected to the oil hole and extending in a circumferential direction of the second upper journal bearing, wherein an inner circumferential surface of each of the first upper journal bearing and the first lower journal bearing is comprised of a surface of revolution created by a straight line, as a generatrix, in parallel with a rotational axis of the crankshaft, wherein the oil is supplied to between the first upper journal bearing and the first lower journal bearing, and the first crank journal, only through a passage passing through the oil hole, and wherein in-shaft oil passages are not formed between the outer circumferential surface of the crank pin and the first crank journal.

2. The structure of claim 1, wherein an inner circumferential surface of the second lower journal bearing is comprised of a surface of revolution created by a straight line, as a generatrix, in parallel with the rotational axis of the crankshaft.

3. The structure of claim 2, wherein the crank pin is a first crank pin and the in-shaft oil passage is a first in-shaft oil passage, wherein the crankshaft further includes:

a third crank journal disposed adjacent to the second crank journal having a gap therebetween on an opposite side from the first crank journal in the given direction;

a second crank pin disposed between the second crank journal and the third crank journal in the given direction; and a second in-shaft oil passage configured to draw the oil from the outer circumferential surface of the second crank journal to an outer circumferential surface of the second crank pin, wherein the cylinder block further includes a third bearing part disposed to surround radially outward of the third crank journal and configured to axially support the crankshaft to be rotatable, wherein the crankshaft bearing structure further comprises a third upper journal bearing and a third lower journal bearing attached to an upper part and a lower part of the third crank journal, respectively, between the third crank journal and the third bearing part in a state where the crankshaft is rotatable, wherein the third upper journal bearing includes an oil hole connected to the oil passage and configured to supply oil from the oil passage to between the third upper journal bearing and the third lower journal bearing, and the third crank journal, and an inner circumferential surface comprised of a surface of revolution created by a straight line, as a generatrix, in parallel with the rotational axis of the crankshaft, and wherein the oil is supplied to between the third upper journal bearing and the third lower journal bearing, and the third crank journal, only through a passage passing through the oil hole.

4. The structure of claim 3, wherein the crank pin includes, on the outer circumferential surface thereof, an opening provided as an end of the in-shaft oil passage.

5. The structure of claim 1, wherein the crank pin is a first crank pin and the in-shaft oil passage is a first in-shaft oil passage, wherein the crankshaft further includes:

a third crank journal disposed adjacent to the second crank journal having a gap therebetween on an opposite side from the first crank journal in the given direction;

a second crank pin disposed between the second crank journal and the third crank journal in the given direction; and a second in-shaft oil passage configured to draw the oil from the outer circumferential surface of the second crank journal to an outer circumferential surface of the second crank pin, wherein the cylinder block further includes a third bearing part disposed to surround radially outward of the third crank journal and configured to axially support the crankshaft to be rotatable, wherein the crankshaft bearing structure further comprises a third upper journal bearing and a third lower journal bearing attached to an upper part and a lower part of the third crank journal, respectively, between the third crank journal and the third bearing part in a state where the crankshaft is rotatable, wherein the third upper journal bearing includes an oil hole connected to the oil passage and configured to supply oil from the oil passage to between the third upper journal bearing and the third lower journal bearing, and the third crank journal, and an inner circumferential surface comprised of a surface of revolution created by a straight line, as a generatrix, in parallel with the rotational axis of the crankshaft, and wherein the oil is supplied to between the third upper journal bearing and the third lower journal bearing, and the third crank journal, only through a passage passing through the oil hole.

6. The structure of claim 1, wherein the crank pin includes, on the outer circumferential surface thereof, an opening provided as an end of the in-shaft oil passage.

7. The structure of claim 2, wherein the crank pin includes, on the outer circumferential surface thereof, an opening provided as an end of the in-shaft oil passage.

8. The structure of claim 5, wherein the crank pin includes, on the outer circumferential surface thereof, an opening provided as an end of the in-shaft oil passage.

* * * * *